US005297797A

United States Patent [19]

Lamontagne

[11] Patent Number: 5,297,797

[45] Date of Patent: Mar. 29, 1994

[54] GOLF BALL STEP-FEEDING SELF-TEEING DEVICE

[76] Inventor: Alain Lamontagne, 44, Des Hirondelles Street, La Plaine, Canada, J0N 1B0

[21] Appl. No.: 20,808

[22] Filed: Feb. 22, 1993

[51] Int. Cl.[5] ..... A63B 57/00

[52] U.S. Cl. ..... 273/201

[58] Field of Search ..... 273/201, 33

[56] References Cited

U.S. PATENT DOCUMENTS

| | | | |
|---|---|---|---|
| 284,107 | 10/1928 | Lange et al. . | |
| 2,127,282 | 8/1938 | Beckett | 273/33 |
| 2,198,968 | 4/1940 | Jewett | 273/201 |
| 3,511,507 | 5/1970 | Gentiluomo | 273/201 |
| 3,519,275 | 7/1970 | Meierjohan | 273/201 |
| 3,738,662 | 6/1973 | Hodgin | 273/201 |
| 3,901,515 | 8/1975 | Mozel | 273/201 |
| 3,966,213 | 6/1976 | Bradley | 273/201 |
| 4,017,087 | 4/1977 | Bruno | 273/201 |
| 4,141,558 | 2/1979 | Hoffman | 273/201 |

*Primary Examiner*—Vincent Millin

*Assistant Examiner*—Steven B. Wong

*Attorney, Agent, or Firm*—Pierre Lespérance; Francois Martineau

[57] ABSTRACT

A device for step-feeding golf balls one at a time over a tee located beneath a ground play surface, and for reciprocating the tee (and associated golf ball) vertically through an aperture made in the ground play surface. The striking height of the tee is adjustable with a control lever. At the selected upper limit position of the tee, the ball can be struck by a golf club, whereby the resilient tee will swing laterally under the impact blow before returning to its initial upright position. The ground surface edge surrounding the tee passage aperture carries a downturned arcuate lip, defining a generally funnel shape configuration. Hence, during lateral sway of the resilient tee after club impact, the tee body will smoothly conform to the arcuate shape of the lip, without contacting the platform bore edge, before returning to its original upright orientation. This in effect substantially reduces the occurrence of shearing damage about the rubber tee.

8 Claims, 4 Drawing Sheets

GOLF BALL STEP-FEEDING SELF-TEEING DEVICE

FIELD OF THE INVENTION

The invention relates to the field of implements used for individual training in the game of golf, usually in golf practice driving ranges, and more particularly to a golf ball step-feeding and self-teeing device.

BACKGROUND OF THE INVENTION

U.S. Pat. No. 3,511,507 issued in 1970 to Joseph A. GENTILUOMO discloses a device for repeatedly setting in automatic fashion a golf ball 21 in position over a ground surface 42, thus relieving the golfer from the task of repeatedly bending over to position a ball supporting tee after each ball stroke with a golf club. A golf ball is brought over a tee member automatically under gravity-borne forces, along inclined track 12. A flexible push-pull member 26 is endwisely anchored to the tee member 22. The push member 26 moves the tee member 22 and overlying golf ball 21 along a vertical axis, through an aperture 43 made in the overlying ground surface 42. At its upper limit position, the elastomeric tee member 22 projects upwardly beyond the horizontal plane of the ground surface, through the aperture 43. As the golfer strikes the ball, the tee 22 will usually swing violently against the edge of the aperture 43 in the ground surface, thus laterally shearing the tee member 22. Eventually, the tee member will become sufficiently damaged to require servicing. This will occur at regular, relatively short intervals.

U.S. Pat. No. 3,519,275 issued in 1938 to Meierjohan, and U.S. Pat. No. 2,127,282 issued in 1938 to Beckett, both teach means for step-feeding a series of golf ball, one at a time, to a loading chamber, where a tee member will reciprocate vertically. This step-feeding of the balls occurs through an inclined chute, whereby the balls are fed to the loading chamber under gravity-borne forces. Two gates are provided transversely of the inclined chute at a lengthwisely spaced interval. The first gate, proximal to the loading chamber, constitutes a releasable abutment stop for the lead ball, while the second gate, distal to the loading chamber, constitutes a releasable abutment stop for the ball following the lead ball. With the second gate closed, the first gate is opened, to allow the lead ball to fall into the loading chamber, and then the latter gate is closed; the second gate is then opened, to allow the next ball to take the place of the lead ball and come to abut against the first gate.

OBJECTS OF THE INVENTION

The gist of the invention is to thus provide a golf teeing device which has means to substantially dampen the lateral sway motion of the vertically reciprocatable teeing member thereof yieldingly upon swinging golf club impact blow thereon.

A general object of the invention is to increase the useful lifetime of the teeing member thereof, and as corollary, to substantially extend the time periods between maintenance downtime of the automatic golf teeing device.

An important object of the invention is to provide a golf teeing device, with means enabling the lay golfer to incrementally adjust the (non-preset) operative height of the tee, before striking at the tee-supported ball.

SUMMARY OF THE INVENTION

In accordance with the objects of the invention, there is disclosed a ball step-feeding, self-teeing device for use in golf training, comprising: (a) a base frame, having a generally horizontal top platform over which a golfer is to swing his golf club, said top platform having a through-bore for vertical through passage of a golf ball, said top platform defining an inner edge portion circumscribing said through-bore; (b) a push-pull, remote, reciprocatable, mechanical coupling means, having transmitter and receiver ends and a flexible diverting means associated with said receiver end, said remote coupling means having a sturdy, impact resistant tee member mounted at said receiving end thereof, said tee member destined to stably support a selected one golf ball; (c) drive means, operatively connected to the transmitter end of said remote coupling means to power operate the latter in its reciprocating motion; d) control means, to impart a generally vertical, sequential, reciprocating movement to said tee member through said platform through-bore between a lower, ball receiving, limit position, located beneath said top platform, and a top, ball hitting, limit position, lcoated above siad top platform, said flexible diverting means enabling resilient lateral sway of said tee member from said top limit position yieldingly upon the tee position; (e) a ball conveying means, for transporting balls to said tee member when the latter stands in its said lower position; (f) ball step-feeding means, associated with said ball conveying means for incrementally feeding a selected one of said balls, one at a time, from said ball conveying means to said tee member, when said tee member is at its said lower limit position, a single ball being fed to said tee member for each complete reciprocating cycle of said tee member; and (g) dampening means, mounted to said platform inner edge portion and cooperating with said flexible diverting means in dampening the lateral sway motion of said tee member in said top limit position, upon the tee member sustaining a transverse impact blow from the golfer's swinging club, wherein said tee member will remain undamaged from this transverse impact blow and wherein said tee member clears said platform inner edge portion and thus escapes undamaged from said club impact blow.

DETAILED DESCRIPTION OF THE INVENTION

Figure 1:
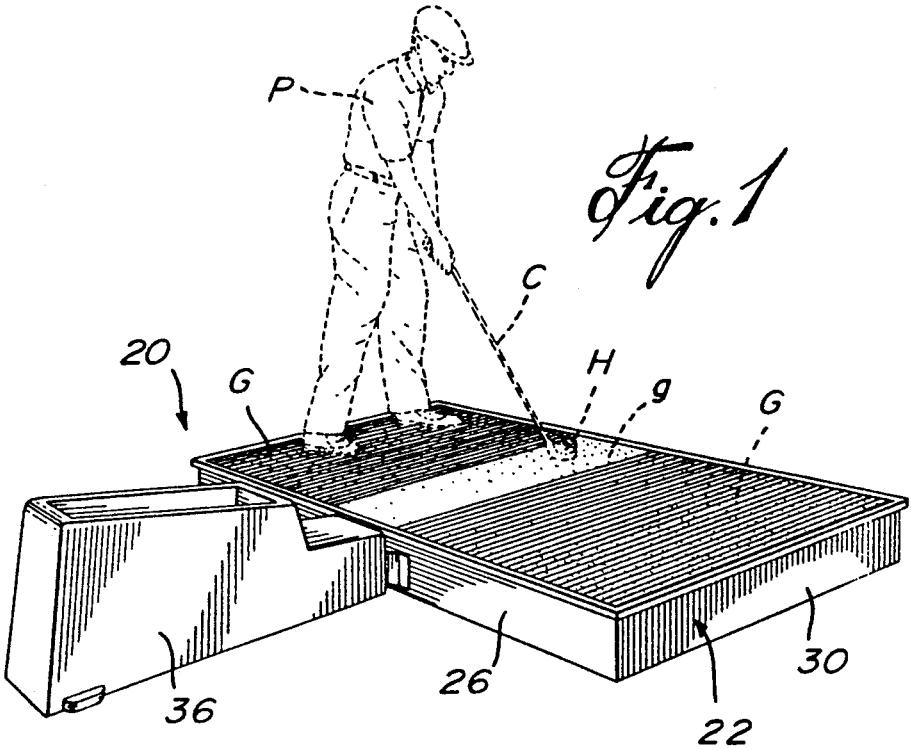
FIG. 1 is an isometric view of a golf training platform and associated ball step-feeding device, showing in phantom lines a golfer ready for swinging at the golf ball with his golf club.
Figure 2:
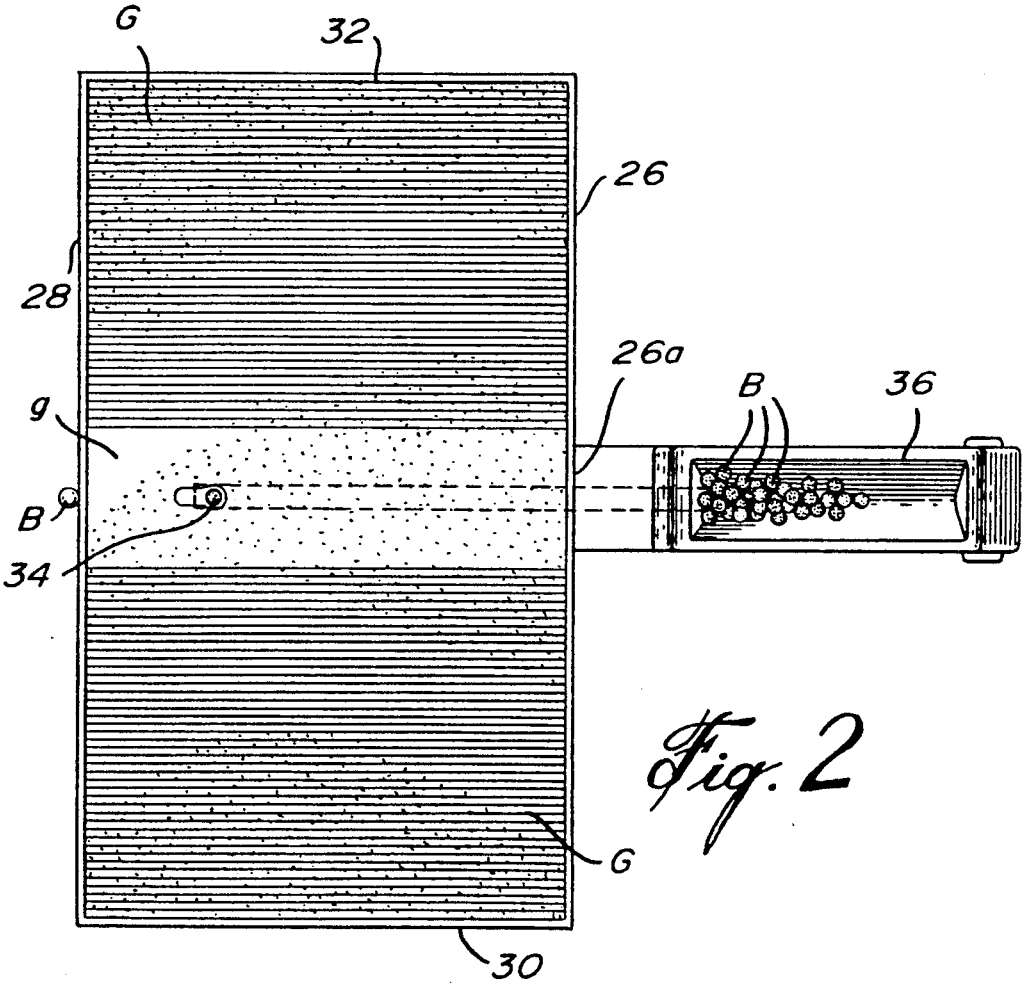
FIG. 2 is a top plan view of the platform and step-feeding device of FIG. 2.

As illustrated in FIGS. 1-2 of the drawings, the golf swing practice implement 20 includes a box-like hollow casing 22 defining a top rectangular panel 23, a bottom rectangular panel 24, and four side edge flanges 26, 28, 30, and 32 that integrally interconnect the four edges of each top and bottom panels 22 and 24. A bore 34 opens centrally of horizontal panel 24. A ball reservoir 36 is attached to a section 26*a* of one long side edge flange, 26, the reservoir containing a plurality of golf balls B.

Preferably, the outer (top) face of the top panel 24 is fitted with a layer of rubber carpet, G. About the portion of platform 22 in register with the flange section 26*a* (and thus with the ball reservoir 36) is fitted a synthetic grass layer, g.

A golfer P preferably uses the training platform 22 as follows: with his two feet on rubber carpet G, he extends his golf club C toward the grass area, g, whereby the club head H may stand flatly over grass g on the platform, in register with the bore 34. The golfer is to swing away from the bore 34, spacedly over the ball reservoir 36. The height of the reservoir should be low enough so as never to impede upon this swinging motion of the club. As we will now see, a selected golf ball B is to be releasably supported over bore 34, through a tee member 38.

An elongated, push-pull, flexible coupler 40 is engaged at one end into a horizontally disposed cylinder 42, the latter being anchored by ears 43 to a lateral wall 30 from a large casing 99, casing 99 being movably mounted within the hollow box-like ground frame 22. The elongated coupler may be of the type disclosed in U.S. Pat. No. 3,511,507, see references 33-38 in FIG. 3 of this latter patent. A number of idle rollers 44, 46, 48 are axially carried to opposite lateral walls 30 and/or 32 of this movable casing 99, in axial register with the cylinder 42, orientation, at the inner portion thereof exiting from the cylinder 42, to a generally vertical orientation, at the outer portion thereof (distal from cylinder 42).

Figure 4:
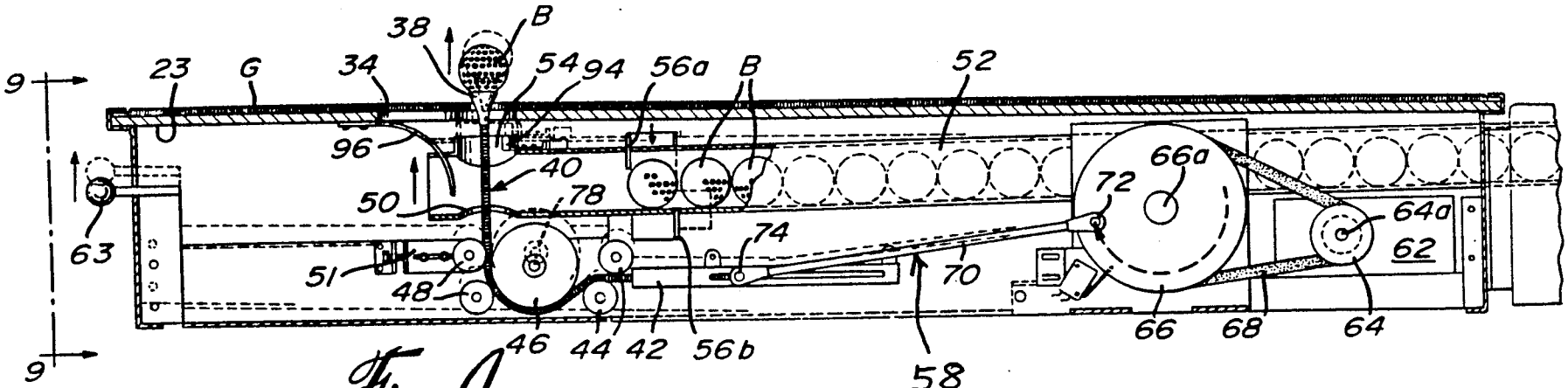
Figure 5:
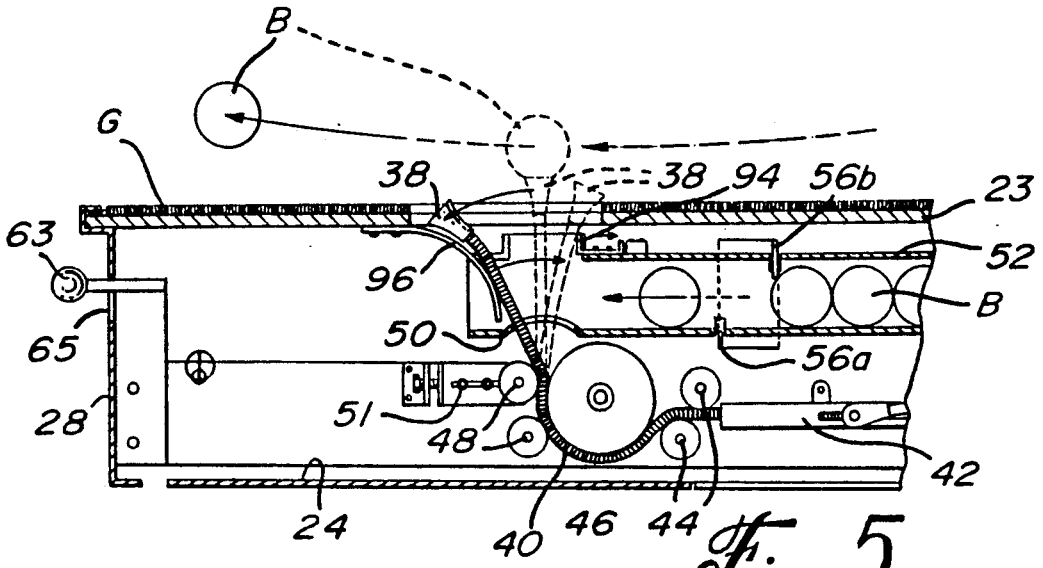

As suggested in FIGS. 4-5, the assembly of idle rollers 44-48 is preferably adjustably mounted to casing 99, about a horizontal axis, via an adjustment means 51. Adjustment means 51 enables relative displacement of idle rollers 44-48, as a function of the overall distance between vertically registering bores 50, 54 and 34, as well as a function of the diameter of the three latter bores. The function of position adjustment means 51 is not only to bias the distal portion of flexible rod 40 into a vertical orientation, but also to make sure that tee member 38 extends short of the trailing edge of rigid platform 23 about top bore 34 (cooperatively with the total stroke length of crank arm 70).

This prevents the tee 38 or rod 40 from striking this bore edge 34, which was the cause in prior art teeing devices of damage to the tee member and/or supporting coupler means.

Flexible coupler 40 carries at its distal end the tee member 38. Tee member 38 defines a semi-spherical, concave, top end recess 38*a*, (FIG. 8) for receiving and supporting in stable condition a ball B. Flexible coupler 40 is extensible from a retracted condition, illustrated in FIG. 3, to an extended condition, illustrated in FIG. 4, the top end of the tee member 38 remaining horizontal at all times whereby a ball deposited thereon will remain thereon by its own weight.

In the lower limit position of tee member 38, the top end recess 38*a* thereof opens into the bottom mouth 50 of a slightly inclined, albeit generally horizontal ball feeding pipe 52, at one end thereof. Pipe 52 is also anchored to frame 22. An outlet port 54 is further defined through pipe 52, above mouth 50. Vertically reciprocatable tee member 38, mouth 50, outlet port 54, register. Mouth 50 is diametrally smaller than ball B, but outlet port 54 and platform through-bore 34 are diametrally larger than ball B; while mouth 50, port 54 and bore 34 are all diametrally larger than tee member 38.

Figure 7:
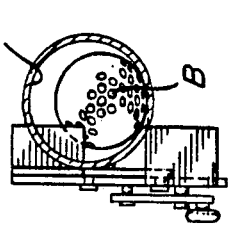
FIGS. 7 and 8 are sectional views taken along lines 7—7 and 8—8 respectively of FIG. 6.

A selected ball B is gravity fed from the ball reservoir in pipe 52, toward and over mouth 50 where it self-immobilizes over the bore. The specific height reached by the tee member 38 is not preset, but can be adjusted as will be detailed hereinbelow. Step-feeding means 56 are provided, to control the incremental feeding of a single lead ball B to be biased over mouth 50, exclusively of the trailing ball B and other balls inside the reservoir 52. Such step-feeding means may be of any conventional type, e.g. a double-gate mechanism 56 as disclosed in U.S. Pat. No. 3,519,275 (see elements 124 and 128 in FIG. 7 of that latter patent).

According to the particular teachings of the present invention, two additional features are provided: (a) drive means 58, to both reciprocate the flexible coupling rod, 40, as well as actuate in successive fashion each of the two gates 56*a*, 56*b*, from the ball step-feeding, double gate system, 56; (b) impact dampening means 60, located on the trailing side of the platform bore 34 (that is, on the side of bore 34 distal relative to the position of the golfer), for receiving all of the tee member 38 and the adjacent end portion of the flexible coupling rod 40, upon the latter being subjected to a distal lateral sway following impacting blow sustained from a swinging golf club having transversely struck the tee member 38; the tee member 38 therefore positively does not shearingly engage against the platform edge of the bore 34, and thus remain undamaged even after several club blows.

The drive means 58 is illustrated in FIGS. 3-4 and 6, 8 of the drawings. A motor unit 62 (FIG. 4), e.g. electrically powered, is mounted to frame 22 proximate wall 26. Motor unit 62 is controlled by suitable control means, these control means preferably consisting of two switches 94 and 95 and a relay 98. Motor unit 62 drives a drive pulley 64, which is transversely frictionally connected to a diametrally larger pulley 66 through an elastomeric belt 68. Pulleys 64, 66 rotate about axes 64*a*, 66*a* parallel to one another and transversely mounted to lateral walls 30 and/or 32. An elongated crank arm 70 is pivotally carried at one end eccentrically of the large pulley 66, about transverse pivot axle 72, and at the opposite end to the flexible coupler rod 40, by a transverse pivot axle 74 extending through an ovoidal slit 76 made lengthwisely of horizontal cylinder 42. Pivot axle 72 may be located on the side of large pulley 66 opposite the ball feed pipe 52.

Hence, as motor unit 62 is started, drive pulley 64 entrains large pulley 66 frictionally via endless belt 68; rotation of large pulley 66 brings pivot axle 72 into translational motion, which in turn brings crank arm 70 to reciprocate; the distal end of crank arm 70 (relative to the pulley 66) is thus in turn brought into a reciprocating motion, along ovoidal slit 76; and since the inner end of flexible coupler rod 40 is secured to the distal end of crank arm 70 (via pivot means 74), the inner portion of the coupler rod 40 is thus biased into a reciprocating motion as well, repeatedly extending from and retracting into horizontally disposed cylinder 42. This will in turn vertically reciprocate the outer portion of the coupler rod 40, including the tee member 38, since idle rollers 44–48 bias the coupler rod 40 from a generally horizontal orientation—at its inner portion—to a generally vertical orientation—at its outer portion—.

Figure 8:
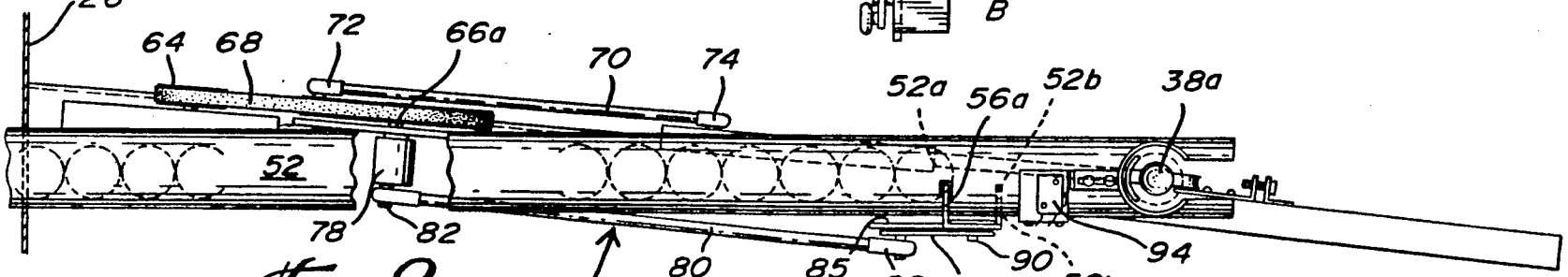

On the side of diametrally large pulley 66 opposite pivot ear 72 of crank arm 70, and as best shown in FIG. 8, pivot axle i 66*a* rotatively carries a cylinder block 78, the latter being diametrally much smaller than pulley 66. Another elongated crank arm, 80, is pivotally connected at one end eccentrically of cylinder block 78, about pivot ear 82, and at its opposite end to one corner of a triangular plate 84, via pivot ear 86. The two other corners of the triangular plate 84 are in turn pivotally connected by pivot axles 88 and 90 to the end portions of two orthogonal legs 85*a*, 85*b*, from the three legs 85*a*–85*c* of a T-shape actuator plate, 85, forming part of the ball step-feeding, double gate mechanism, 56. Moreover, the mount of axle 90 through T-plate 85 is an ovoidal slot 91, slot 91 extending generally parallel to crank arm 80.

T-Plate 85 is connected about its leg 85*c* to a portion of ball feed pipe 52 proximate ball mouth 54, via a pivot axle 87 transversely anchored to pipe 52 and slidingly engaged into an ovoidal slot 89 made in leg 85*c*. The gates 56*a*, 56*b* of the double gate mechanism project transversely from the end portions of legs 85*b* and 85*c*, on the side opposite triangular plate 84, and are releasably engageable into corresponding slits 55*a*, 52*b* made on the top and bottom arcuate sides respectively of ball feed pipe 52.

Hence, rotation of pulley axle 66*a* and associated cylinder block 78 will bring ear 82 into translational motion, thus reciprocating crank arm 80; this in turn will tilt the triangular plate 84 in a swinging fashion. That is to say, reciprocating motion of crank arm 80 will bias triangular plate 85 to pivot around pivot means 88. Accordingly, the pivot end 90 of triangular plate 84 will reciprocate vertically, since ovoidal slit 91 is generally parallel to elongated rod 80. Therefore, vertical base legs 85*b* and 85*c* will also reciprocate vertically, being enabled by the sliding engagement of pivot axle 87 into vertical ovoidal slot 89. This in turn will bring about engagement of one gate 56*a* through pipe 52, as the other gate 56*b* disengages therefrom, and vice-versa.

Figure 3:
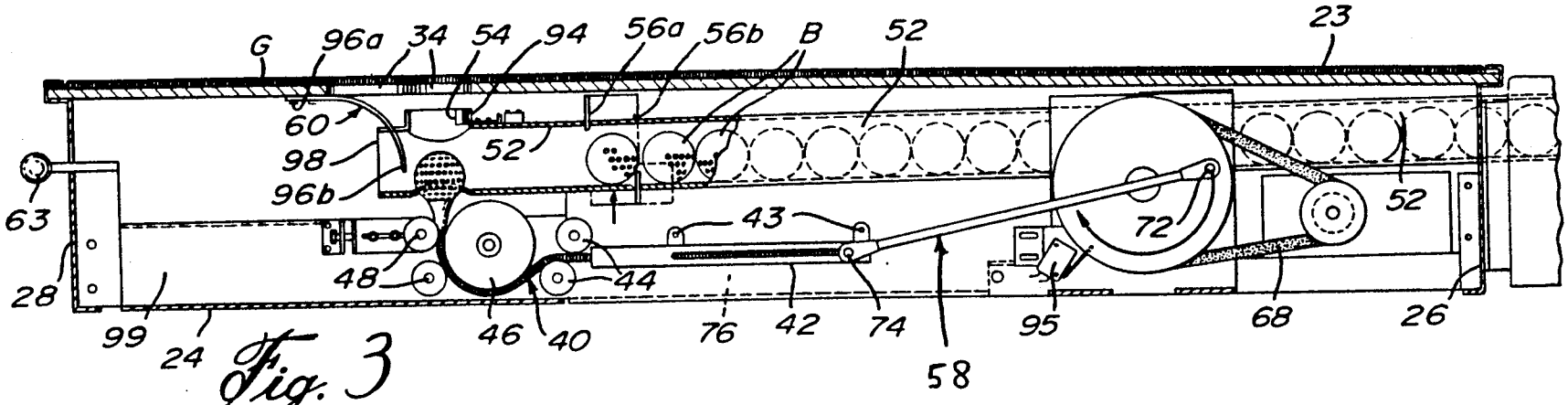
FIGS. 3, 4 and 5 are vertical sectional views of the step-feeding device, sequentially suggesting how a golf ball can be raised by the tee member to its upper limit position (FIG. 4), and then what is the play of the tee member upon sustaining impact blow from the golf club, and further suggesting how the flexible coupler rod is reciprocated by the drive means.

This indeed ensures that, each time the tee member 38 is brought (by crank arm 70 and coupler arm 40) to its lower limit position (illustrated in FIG. 3), a single ball B will be fed over the concave top recess 38*a* thereof by sequential, successive opening and closure of gates 56*a* and 56*b*, namely:

(a) trailing gate 56*b* is opened while leading gate 56*a* is closed, to enable a first golf ball B to reach the lead position shown in FIG. 4; then (b) trailing gate 56*b* is closed and leading gate 56*a* is opened, as illustrated in FIG. 3, to enable the lead ball to engage the top surface of bore 50 and remain thereon (tee member 38 has been previously brought beneath bore 50 by flexible coupler 40);

(c) tee member 38 and selected ball B are lifted by coupler rod 40—under the impacting bias of the rearwardly yieldingly moving tee member 38;

(d) as ball B and tee member 38 are struck by the golf club, ball B moves away over platform 23, while tee member 38 swings laterally and engage arcuate damper means 60 on the trailing side of pipe (e) under the resiliency of flexible coupler rod 40, coupler rod 40 and associated tee member 38 rebound against a sensor 94 located on the leading edge of pipe bore 54 (opposite damper means 60);

(f) contact with sensor 94 by rod 40 triggers a command via wire control means 95 to the motor drive unit 62 to retract rod 40 via crank arm 70;

(g) lead gate 56*a* concurrently closes while trailing gate 56*b* opens, to allow a following ball B from the ball reservoir 52 to take the place as the new lead ball;

(h) and, upon return of tee member 38 beneath bore 50, the cycle of steps (a) to (g) may be repeated once again.

Impact dampening means 60 preferably consists of a resilient, elongated, flat metallic band, 96, anchored at its top end 96*a* to the underface of platform 23 about the trailing edge portion of bore 34 (i.e. on the side opposite that of the golfer), and freely hanging at its bottom end 96*b* beneath platform 23. The resilient band bottom end 96*b* further engages into ball feed pipe 52, through an end slit 98, and extends about a plane coplanar to that of flexible coupler rod 40 at least at the fully extended condition thereof (FIG. 4). The lowermost edge of the band bottom end 96*b* extends downwardly freely short of the bottom wall of ball pipe 52, and also extends short distally from the virtual vertical cylindrical projection joining bores 50 and 54.

Therefore, arcuate (upwardly convex) band 96 stays clear at all time from the path of travel of vertically reciprocating tee member 38 and the supported ball B, so as not to impede upon their motion. Yet, as the flexible upright rod 40 is violently swung by a golf club impact from its top limit position (FIG. 4), the upper section of rod 40 and the tee member 38 will conformingly engage the trailing band 96. The angle of curvature of band 96 is precisely adjusted, so that band 96 will match the natural, arcuately deformed shape of the rod upper section following the club impact against the top tee member 38; under the strain, band 96 will yieldingly bend away from pipe 52 (FIG. 5), but will eventually and resiliently bias the rod 40 to rebound against said actuating sensor 94 attached to pipe 52 at the opposite section of top bore 54.

Figure 9:
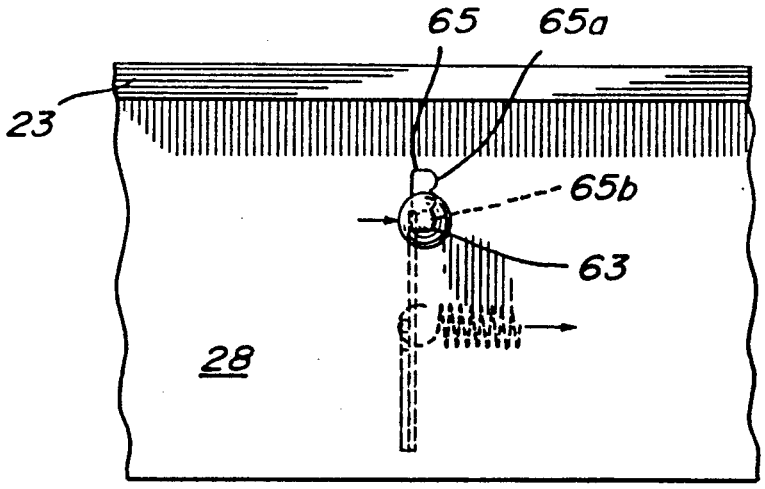
FIG. 9, on the third sheet of drawings, is an end view taken from perspective 9—9 of FIG. 4.
Figure 6:
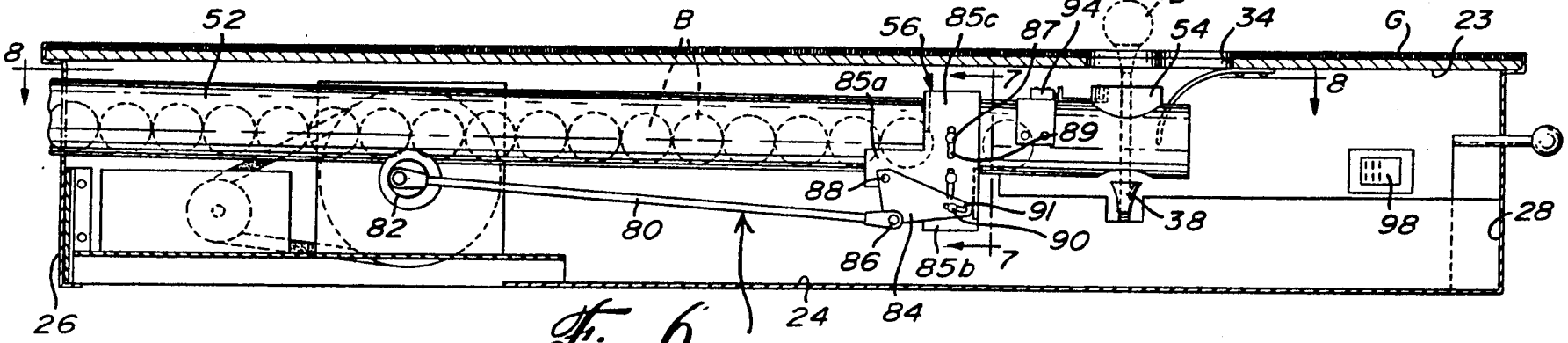
FIG. 6 is a view similar to FIGS. 3–5, but from an opposite side view of the golf training platform, and further showing how the ball step feeding, double gate mechanism is tilted by the same drive means as for the flexible coupler rod.

It is understood from FIG. 9 of the drawings, that control lever 63 is anchored to and transversely projects from the movable inner casing 99, and extends transversely through and beyond a vertical slit 65 made in wall 28 of the external golf box 22. (The dotted lines in FIGS. 4 suggest the vertical play of the inner casing 99 within outer frame 20, as the control lever 63 is actuated) Vertical slit 65 includes at least a few, vertically spaced, transverse recesses 65*a*, 65*b*, . . . , each recess defining a seat for the lever 63 when selectively engaged therein. Lever 63 constitutes a height adjustment control, for selecting the desired height of the ball-supporting tee 38. This height adjustment of the tee 38 is therefore not preset nor fixed to a permanent height. Thus, the golfer can himself set the desired tee height (i.e., the vertical distance between the plane of grass layer g and the top surface of tee 38) at which height the golfer feels he is most comfortable for striking at the golf ball. Lifting lever 63 along wall slit 65 raises the tee 38, lowering lever 63 has the opposite effect; the lateral recesses 65*a*, 65*b*, set a temporary height level selected for the tee 38.

An alternate embodiment of incremental (step-feeding one at a time) ball stopper could consist of a generally C-shape gate assembly (not illustrated), defining a main vertical web, a short top horizontal leg and a long horizontal leg. The web would also include a coaxial projecting ear, this ear being hooked to the push rod 40, wherein the C-gate would be tiltable. The top leg would carry a first transverse finger, movable transversely through the leading end slit of the ball feed pipe 52, while the bottom leg would carry a second transverse finger, movable transversely through the trailing end slit of the ball feed pipe 52. When the motor 62 is powered, the push rod 40 pulls back, and then, the leading end first finger extends transversely through the ball feeding pipe 52 to stop the leading golf ball. In this position, the ball trapped between the horizontally spaced leading and trailing vertical fingers may then become released, under tilting action of the C-gate.

This simplified version of a ball stopper could be mounted on a pipe, vertically or horizontally. It requires only about 1.3 centimeters axial play (forward and reverse motion), to operate adequately. This system would require a moulded piece, expensive when considering capital (fixed) cost outlay, but more economical in the long run (on operating variable unit costs).

I claim:

1. A ball step-feeding, self-teeing device for use in golf training, comprising:

(a) a base frame, having a generally horizontal top platform over which a golfer is to swing a golf club, said top platform having a through-bore for vertical through-passage of a golf ball, said top platform defining an inner edge portion circumscribing said through-bore;

(b) a push-pull, reciprocatable, mechanical coupling means, having transmitter and receiver ends and a flexible means associated with said receiver end, said coupling means having a sturdy, impact-resistant tee member mounted at said receiver end thereof, said tee member destined to stably support a selected golf ball;

(c) drive means, operatively connected to the transmitter end of said coupling means to power operate said transmitter end in its reciprocating motion;

d) control means, to impart a generally vertical, sequential, reciprocating movement to said tee member through said platform through-bore between a lower, ball-receiving, limit position, located beneath said top platform, and a top, ball-hitting, limit position, located above said top platform, said flexible means enabling resilient lateral sway of said tee member from said top limit position yieldingly upon the tee member sustaining a lateral striking blow at said top limit position;

(e) a ball conveying means, for transporting balls to said tee member when said tee member stands in its said lower position;

(f) ball step-feeding means, associated with said ball conveying means for incrementally feeding a selected one of said balls, one at a time, from said ball conveying means to said tee member, when said tee member is at its said lower limit position, a single ball being fed to said tee member for each complete reciprocating cycle of said tee member; and (g) dampening means, mounted to said platform inner edge portion and cooperating with said flexible means in dampening the lateral sway motion of said tee member in said top limit position, upon the tee member sustaining a transverse impact blow from the golfer's swinging club, wherein said tee member will remain undamaged from this transverse impact blow and wherein said tee member clears said platform inner edge portion and thus escapes undamaged from said club impact blow.

2. A ball step-feeding, self-teeing device for use in golf training as defined in claim 1, wherein said dampening means comprises a resilient, elongated, flat, upwardly-convex arcuate band, said band anchored at one end to the under surface of said platform inner edge portion, on the side of said through-bore opposite relative to said golf club, and downwardly-inwardly-extending at its opposite end toward said receiver end of said coupling means, said band extending generally complex to said tee member.

3. A ball step-feeding, self-teeing device as in claim 1, wherein said ball step-feeding means is controlled and actuated by said drive means, concurrently with said push-pull coupling means.

4. A self-teeing device as in claim 1, wherein said control means includes a sensor means, said sensor means responsive to the lateral swinging motion of said mechanical coupling means through said platform through-bore following said golf club tee member impact.

5. A self-teeing device as in claim 4, wherein said drive means includes:

(a) a pulley member, axially carried to said base frame and defining one and another opposite sides;

(b) an elongated first crank arm, pivotally connected at one end eccentrically to said pulley member one side and at the opposite end to said mechanical coupling means transmitter end, said transmitter end being engaged into a generally horizontal channel means being anchored to said base frame;

(c) an elongated second crank arm, pivotally connected at one end eccentrically to said pulley member another side and at another opposite end to a double-gate means forming part of said ball step-feeding means.

6. A self-teeing device as in claim 5, wherein the eccentricity of said first crank arm is greater than that of said second crank arm.

7. A self-teeing device as in claim 6, wherein said second crank arm another end is pivotally connected to a first corner of a triangular plate defining first, second and third corners, said second and third corners being pivotally connected to first and second legs from a T-shape actuator plate having first, second and third legs with said first and second legs being orthogonal to one another, said third leg thereof pivotally connected to said ball conveying means, said second and third legs thereof respectively carrying corresponding one and another ball-stop gates forming part of said double-gate means, said one gate being open when said another gate is closed, and vice-versa.

8. A ball step-feeding, self-teeing device for use in golf training over a horizontal platform, said device comprising:

(a) a push-pull coupling means, having a flexible means and an upstanding tee member, wherein said tee member is to be located proximate to and to be movable transversely relative to said platform, said tee member destined to stably support a selected golf ball, said flexible means enabling resilient lateral sway motion of said tee member yieldingly upon the upstanding tee member sustaining a lateral striking blow from a golf club;

(b) a ball conveying means, for transporting balls one at a time to said tee member; and (c) dampening means, to be mounted to said platform and cooperating with said flexible means in dampening the lateral sway motion of said tee member upon the tee member sustaining a transverse impact blow from the golfer's swinging club, wherein said tee member is to clear said platform so as to remain substantially undamaged from this transverse impact blow.

* * * * *